US011466863B2

(12) United States Patent
Perugu et al.

(10) Patent No.: US 11,466,863 B2
(45) Date of Patent: Oct. 11, 2022

(54) VENTILATION SYSTEM FOR A COOKING APPLIANCE

(71) Applicant: Electrolux Home Products, Inc., Charlotte, NC (US)

(72) Inventors: Vinayak Reddy Perugu, Nashville, TN (US); Sooraj Puthiyaveetil, Hendersonville, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 17/019,838

(22) Filed: Sep. 14, 2020

(65) Prior Publication Data

US 2022/0082266 A1 Mar. 17, 2022

(51) Int. Cl.
*F24C 15/00* (2006.01)
*F24C 15/20* (2006.01)

(52) U.S. Cl.
CPC ..... *F24C 15/006* (2013.01); *F24C 15/2007* (2013.01)

(58) Field of Classification Search
None
See application file for complete search history.

(56) References Cited

U.S. PATENT DOCUMENTS

| | | | | |
|---|---|---|---|---|
| 3,499,430 | A | 3/1970 | Kemp | |
| 3,512,514 | A | 5/1970 | Vonasch | |
| 3,859,499 | A | 1/1975 | Evans et al. | |
| 4,373,504 | A | 2/1983 | Day | |
| 4,430,541 | A | 2/1984 | Day, Jr. | |
| 6,172,338 | B1 | 1/2001 | Barnes et al. | |
| 6,761,159 | B1 | 7/2004 | Barnes et al. | |
| 7,923,663 | B2 | 4/2011 | Kim et al. | |
| 2015/0241069 | A1 | 8/2015 | Brant et al. | |
| 2016/0178218 | A1* | 6/2016 | Kulemin | F24C 15/001 126/21 R |
| 2018/0038596 | A1* | 2/2018 | Briscoe | F24C 15/001 |
| 2020/0191406 | A1* | 6/2020 | Yun | F24C 15/102 |

FOREIGN PATENT DOCUMENTS

| | | |
|---|---|---|
| CA | 869091 | 4/1971 |
| KR | 20070054537 | 5/2007 |
| KR | 20110089767 | 8/2011 |
| KR | 101789538 | 8/2012 |

* cited by examiner

*Primary Examiner* — Jason Lau
(74) *Attorney, Agent, or Firm* — Pearne & Gordon LLP

(57) ABSTRACT

A cooking appliance includes a cabinet; a cooking chamber positioned within the cabinet; a cooling duct positioned within the cabinet above the cooking chamber and configured to accommodate a main cooling airflow therethrough, the cooling duct defining a main inlet at a front of the appliance, an outlet at a rear of the appliance, and one or more auxiliary inlets disposed along a length of the cooling duct; and a fan adapted to motivate the main cooling airflow. The one or more auxiliary inlets includes a rear inlet disposed adjacent to a rear panel of the cabinet.

22 Claims, 11 Drawing Sheets

VENTILATION SYSTEM FOR A COOKING APPLIANCE

FIELD

The present invention relates generally to a cooking appliance, and, more particularly, to a ventilation system for a cooking appliance.

BACKGROUND

Cooking appliances generally include a cabinet and a cooking chamber disposed therein that defines a cooking cavity for receiving food items. Heating elements are disposed within or near the cooking cavity to provide heat to the food items located therein. The heating elements can include a bake heating element positioned below the cooking chamber and/or a broil heating element positioned at a top portion of the cooking cavity.

During operation of such appliances, one or more heating elements are energized to heat the cooking cavity to a selected cooking temperature. This heat, however, can transfer to structure surrounding the cooking chamber such as the cabinet walls or electronics contained within the cabinet, causing that structure to reach undesirable temperatures. Therefore, such appliances include cooling systems to help thermally isolate the cooking chamber by managing the flow of cooling air to protect temperature-sensitive component. For example, a fan may be positioned within the cabinet to force heated air out of the cabinet and replenish it with cooler ambient air, thereby cooling the oven electronics and the cabinet housing.

SUMMARY

In accordance with a first aspect, a cooking appliance includes a cabinet; a cooking chamber positioned within the cabinet; a cooling duct positioned within the cabinet above the cooking chamber and configured to accommodate a main cooling airflow therethrough, the cooling duct defining a main inlet at a front of the appliance, an outlet at a rear of the appliance, and one or more auxiliary inlets disposed along a length of the cooling duct; and a fan adapted to motivate the main cooling airflow. The one or more auxiliary inlets includes a rear inlet disposed adjacent to a rear panel of the cabinet.

In one example of the first aspect, the cooling duct includes an intake channel, the main inlet being defined at an upstream end thereof; a fan compartment downstream of the intake channel; and an exhaust channel downstream of the fan compartment, the outlet being defined at a downstream end of the exhaust channel. The rear inlet is disposed along the exhaust channel.

In another example of the first aspect, the cooling duct is configured to direct the main cooling airflow horizontally above the cooking chamber and then vertically adjacent the rear panel of the appliance.

In yet another example of the first aspect, the cooling duct includes a vertical portion having a front wall and a rear wall spaced from the front wall, the one or more auxiliary inlets including a front inlet defined by the front wall of the vertical portion. In one example, the cabinet includes a control panel having a control-panel inlet, and operation of the fan causes an auxiliary airflow to enter the cabinet through the control-panel inlet and then to enter the cooling duct through the front inlet.

In still yet another example of the first aspect, the cooling duct includes a vertical portion having a front wall and a rear wall spaced from the front wall, the rear inlet being defined by the rear wall of the vertical portion. In one example, the rear panel includes a panel inlet, and operation of the fan causes an auxiliary airflow to enter the cabinet through the panel inlet and then to enter the cooling duct through the rear inlet. In some examples, the rear inlet is configured such that the auxiliary airflow through the rear inlet gradually converges with the main cooling airflow at a sloped angle relative to the main cooling airflow.

In another example of the first aspect, the cooling duct includes a vertical portion having a front wall and a rear wall spaced from the front wall, the one or more auxiliary inlets includes a front inlet defined by the front wall of the vertical portion, and the rear inlet of the one or more auxiliary inlets is defined by the rear wall of the vertical portion.

In yet another example of the first aspect, the cooling duct includes a horizontal portion having an upper wall and a lower wall spaced from the upper wall, and the one or more auxiliary inlets includes an upper inlet defined by the upper wall of the horizontal portion. In one example, the cabinet includes a control panel having a control-panel inlet, and operation of the fan causes an auxiliary airflow to enter the cabinet through the control-panel inlet and then to enter the cooling duct through the upper inlet.

In still yet another example of the first aspect, the cooling duct includes a horizontal portion having an upper wall, a lower wall, and a side wall that connects the upper wall and lower wall, the one or more auxiliary inlets including a side inlet disposed in the side wall. In one example, the rear panel includes a rear inlet, and operation of the fan causes an auxiliary airflow to enter the cabinet through the rear inlet, then to flow along a side wall of the cooking chamber, and then into the cooling duct through the side inlet.

In another example of the first aspect, the cooling duct includes a fan-compartment that at least partially houses the fan, the fan compartment defining a fan-compartment inlet configured to feed an auxiliary airflow directly into the fan compartment. In one example, the cabinet includes a control panel having a control-panel inlet, and operation of the fan causes the auxiliary airflow to enter the cabinet through control-panel inlet and then to enter the cooling duct through the fan-compartment inlet.

In yet another example of the first aspect, the cooking appliance further includes a door having a lower inlet, an upper outlet, and a door channel extending from the lower inlet to the upper outlet. The cabinet has a front inlet arranged adjacent to the upper outlet of the door and the main inlet of the cooling duct, and operation of the fan causes air to flow through the lower inlet into the door channel, then through the upper outlet, then through the front inlet of the cabinet, and then through main inlet of the cooling duct into the cooling duct.

In still yet another example of the first aspect, the cooling duct defines a fume inlet, the cooking chamber includes a fume outlet, and a flue pipe provides fluid communication between the fume inlet of the cooling duct and the fume outlet.

In accordance with a second aspect, a cooking appliance includes a cabinet having a front-panel inlet, a rear-panel inlet, a control-panel inlet, and a rear outlet; a cooking chamber positioned within the cabinet, the cooking chamber having a fume outlet; and a cooling duct positioned within the cabinet above the cooking chamber and configured to accommodate a main cooling airflow therethrough. The cooling duct includes a horizontal portion having an upper wall, a lower wall spaced from the upper wall, and a side wall connecting the upper wall and lower wall; a vertical portion having a front wall and a rear wall spaced from each other, a main inlet disposed at an upstream end of the horizontal portion; an upper inlet defined by the upper wall of the horizontal portion; a side inlet defined by the side wall of the horizontal portion; a front inlet defined by the front wall of the vertical portion; a rear inlet defined by the rear wall of the vertical portion; a rear outlet disposed at a downstream end of the vertical portion; and a fume inlet defined by the lower wall of the horizontal portion. The cooking appliance further includes a fan adapted to motivate the main cooling airflow.

In one example of the second aspect, operation of the fan causes the main cooling airflow to flow through the front-panel inlet into the cabinet and then through the main inlet into the cooling; a first auxiliary airflow to flow through the control-panel inlet into the cabinet and then through the upper inlet into the cooling duct; a second auxiliary airflow to flow through the rear-panel inlet into the cabinet, then along a side wall of the cooking chamber, and then through the side inlet into the cooling duct; a third auxiliary airflow to flow through the control-panel inlet into the cabinet and then through the front inlet into the cooling duct; a fourth auxiliary airflow to flow through the rear-panel inlet into the cabinet and then through the rear inlet into the cooling duct; and fumes within the cooking chamber to flow through the fume outlet of the cooking chamber and then through the fume inlet into the cooling duct. In one example, the cooling duct includes a fan-compartment portion defining a fan compartment that is downstream of the horizontal portion and upstream of the vertical portion, the fan being disposed at least partially within the fan compartment.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION

Figure 1:
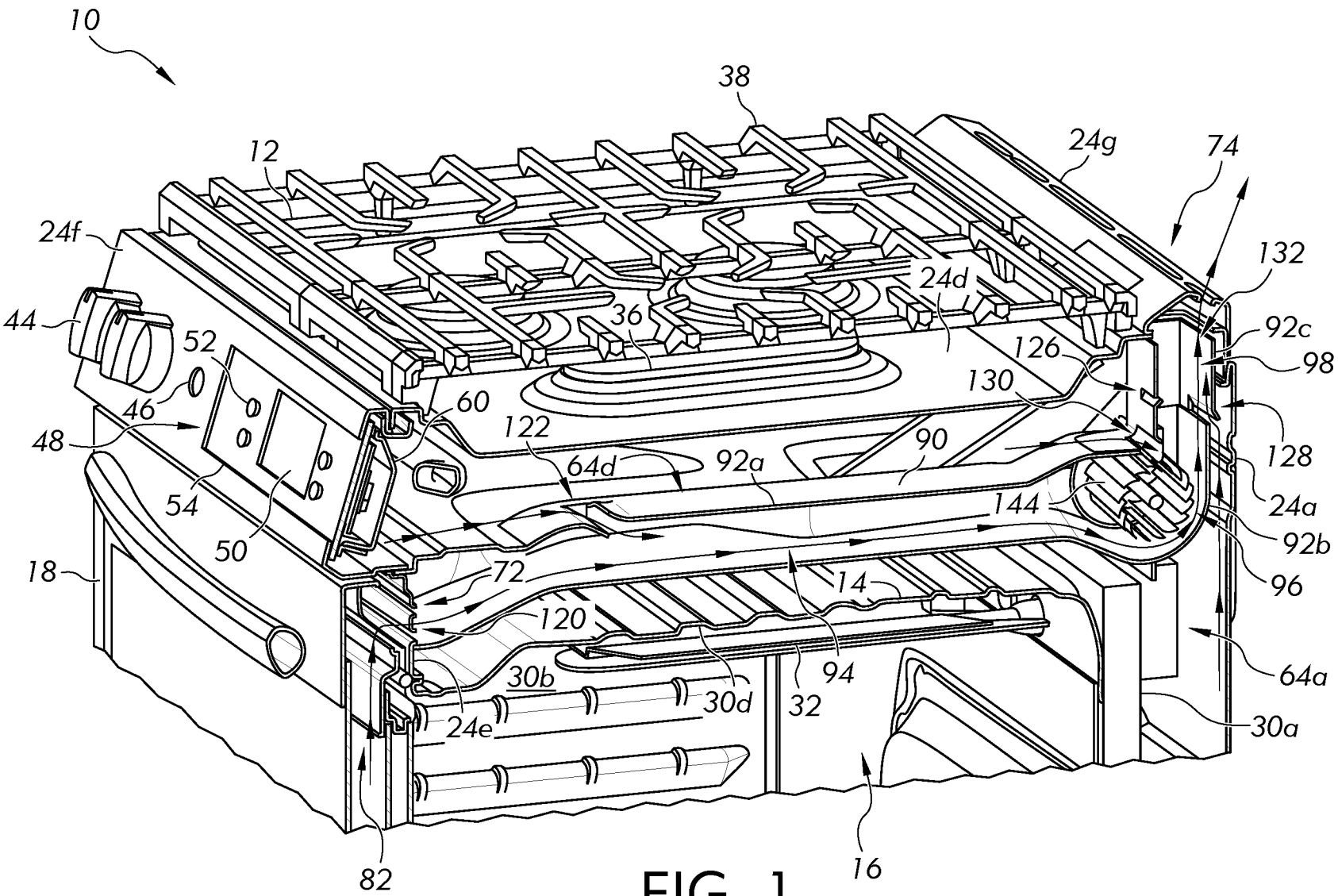
FIG. 1 is a cross-section view of an example cooking appliance.
Figure 2:
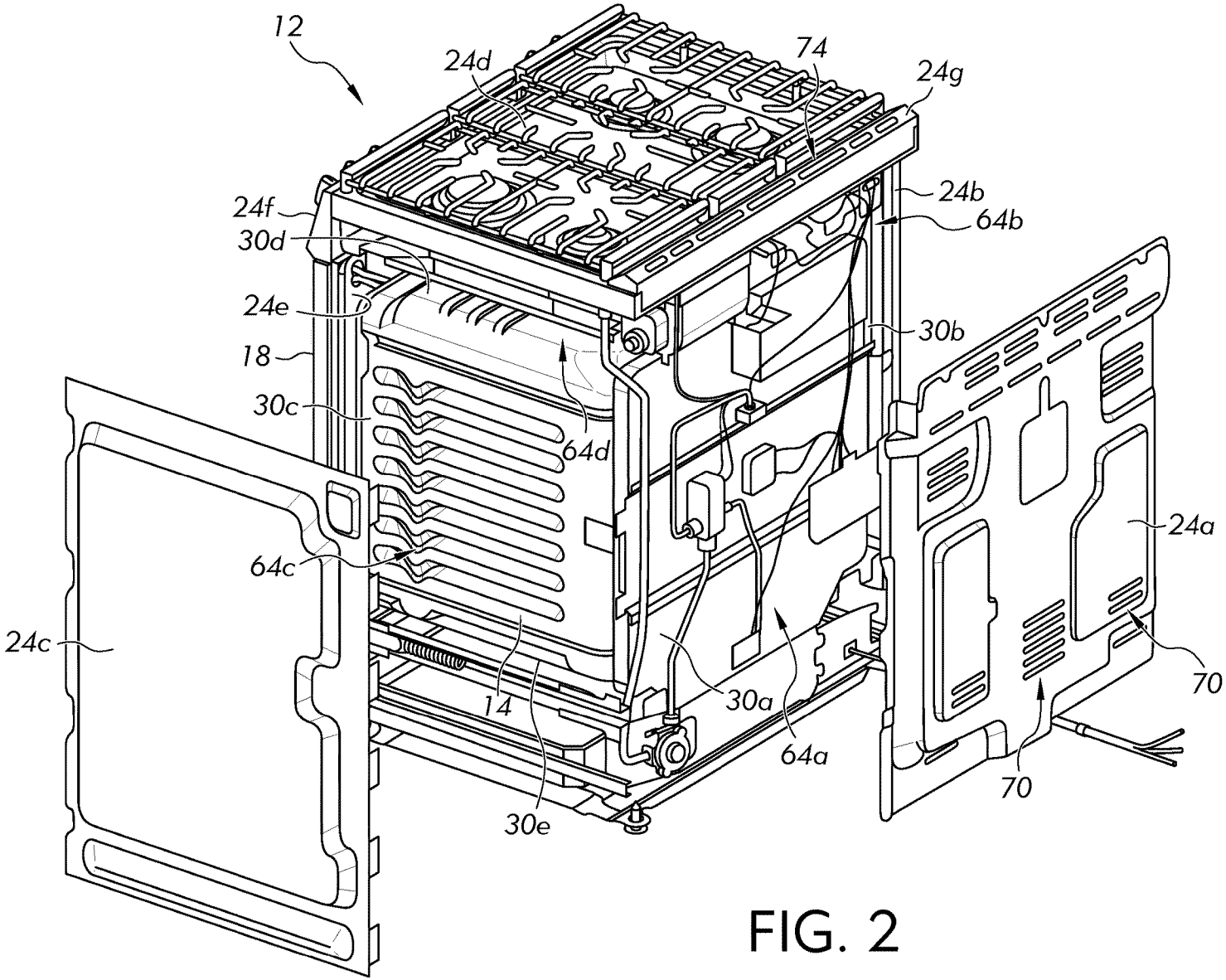
FIG. 2 is a partially exploded view of the cooking appliance.

As shown in FIGS. 1 and 2, an example cooking appliance 10 includes a cabinet 12 and a cooking chamber 14 disposed within the cabinet 12 that defines a cooking cavity 16. The cooking appliance 10 further includes a door 18 mounted to the cabinet 12 that is pivotable between open and closed positions for providing selective access to the cooking cavity 16.

The cabinet 12 includes a plurality of panels 24*a-g* that surround the cooking chamber 14. In particular, the cabinet 12 has a rear panel 24*a*, a left panel 24*b*, a right panel 24*c*, an upper panel 24*d*, a front panel 24*e*, a control panel 24*f*, and a rear exhaust panel 24*g*. Each panel 24*a-g* can be separately formed from a single piece of sheet metal and then assembled with the other panels 24*a-g* using fasteners. However, two or more of the panels 24*a-g* can be integrally formed with each other in some examples. Moreover, one or more panels can comprise a plurality of members (e.g., sheet metal pieces) that are fastened together to the form each panel.

The cooking chamber 14 includes a rear wall 30*a*, a left wall 30*b*, a right wall 30*c*, an upper wall 30*d*, and a bottom wall 30*e* that collectively define the cooking cavity 16. Moreover, the appliance 10 can include one or more heating elements 32 for heating the cooking cavity 16. For example, FIG. 1 shows a gas-broil heating element 32 mounted within an upper portion of the cooking cavity 16. Additional or alternative heating elements 32 can be mounted within or outside of the cooking cavity 16.

The cooking appliance 10 further includes a plurality of cooktop heating elements 36 disposed along the upper panel 24*d* of the cabinet 12. In the present embodiment, the heating elements 36 are gas burners that are mounted at the upper panel 24*d*, although the cooking appliance 10 can have electric heating elements 36 in some examples. The appliance 10 further has one or more cooking grates 38 that rest on the upper panel 24*d* and provide a support surface for placing cooking elements (e.g., pots, pans, etc.) above the heating elements 36.

One or more control elements can be disposed at the control panel 24*f* for controlling the cooking appliance 10. For example, the appliance 10 in the illustrated embodiment has a plurality of control knobs 44 for controlling the cooktop heating elements 36 that are mounted at a front side of the control panel 24*f* and penetrate through a plurality of holes 46 in the panel 24*f* The appliance 10 further has a user interface 48 with a display 50 and capacitive touch buttons 52 that is mounted from a rear side of the control panel 24*f* A cutout 54 is provided in the control panel 24*f* to view and interact with the user interface 48. Additionally, an enclosure 60 is provided that encloses the display 50 on a rear side of the control panel 44.

The heating element(s) 32 can be energized to heat the cooking cavity 16 and cook food contained within. However, this heat can transfer to structure surrounding the cooking chamber 14 such as the door 18, the panels 24 of the cabinet 12, and/or electronics contained within the cabinet 12, causing that structure to reach undesirable temperatures. Accordingly, the appliance 10 includes a ventilation system that is configured to establish airflows through the door 18 and cabinet 12 to effectively and efficiently cool the area surrounding of the cooking chamber 14, in part by thermally isolating the cooking chamber 14 using a flow of cooling air as an insulating layer.

More specifically, the ventilation system includes a plurality of air plenums 64*a-d* defined between the walls 30*a-e* of the cooking chamber 14 and the panels 24*a-g* of the cabinet 12. In particular, a rear plenum 64*a* is defined between the rear wall 30*a* of the cooking chamber 14 and rear panel 24*a* of the cabinet 12, a left plenum 64*b* is defined between the left wall 30*b* of the cooking chamber 14 and left panel 24*b* of the cabinet 12, a right plenum 64*c* is defined between the right wall 30*c* of the cooking chamber 14 and right panel 24*c* of the cabinet 12, and an upper plenum 64*d* is defined between the upper wall 30*d* of the cooking chamber 14 and upper panel 24*d* of the cabinet 12.

Each plenum 64*a-d* can be delimited by the cooking chamber 14 and the cabinet 12 and/or other structure such insulation lining the exterior of the cooking chamber 14 or interior of the cabinet 12. Moreover, each plenum 64*a-d* can be fluidly connected with or isolated from an adjacent plenum. In the present embodiment, the rear plenum 64*a* fluidly connects at its sides with the right and left plenums 64*b*, 64*c*, and all three of those plenums 64*a*, 64*b*, 64*c* fluidly connect at their upper ends with the upper plenum 64*d*.

The ventilation system further includes a plurality of air inlets and outlets for enabling air to flow through the cabinet 12. In particular, the rear panel 24*a* of the cabinet 12 defines a plurality of rear-panel inlets 70 and the front panel 24*e* defines a plurality of front-panel inlets 72 (see FIG. 3). Holes in the control panel 24*f* (such as the holes 46 that accommodate control knobs 44) also can serve as control-panel inlets of the cabinet 12. Moreover, the rear exhaust panel 24*g* defines a plurality of rear outlets 74. It is to be appreciated that the number and location of the cabinet's air inlets and outlets can vary in different embodiments.

Figure 3:
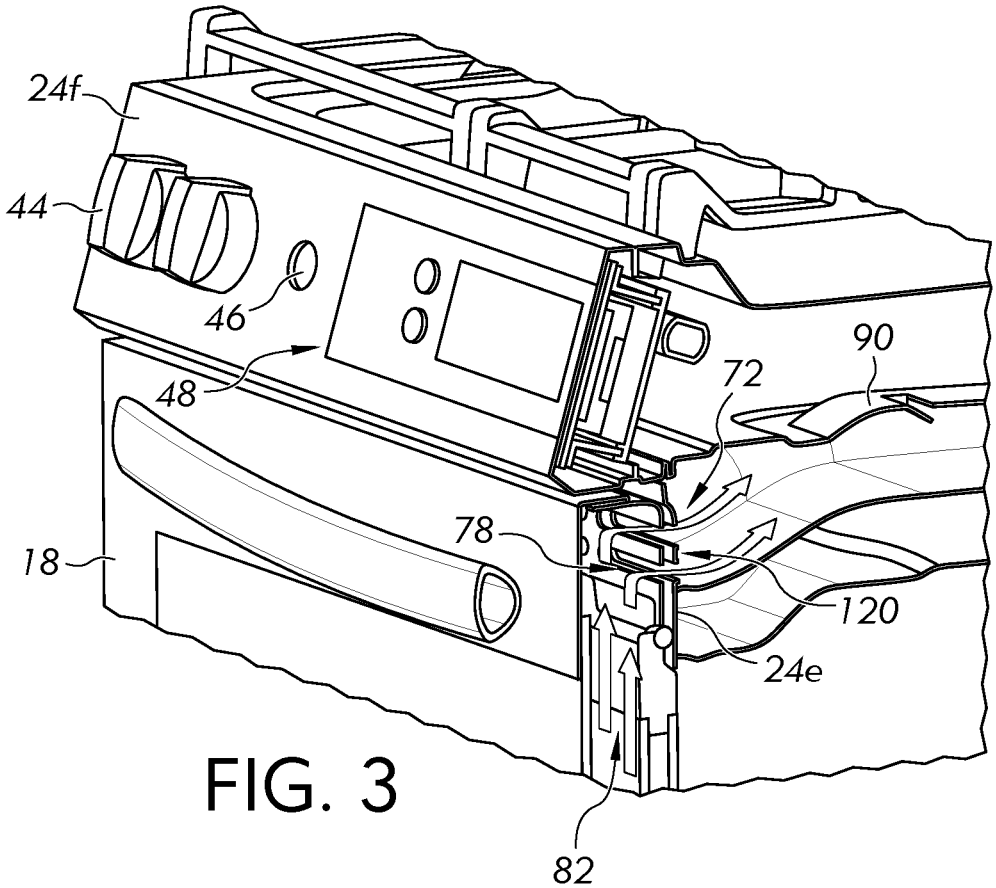
FIG. 3 is an enlarged cross-section view showing an upper portion of a door for the cooking appliance.
Figure 4:
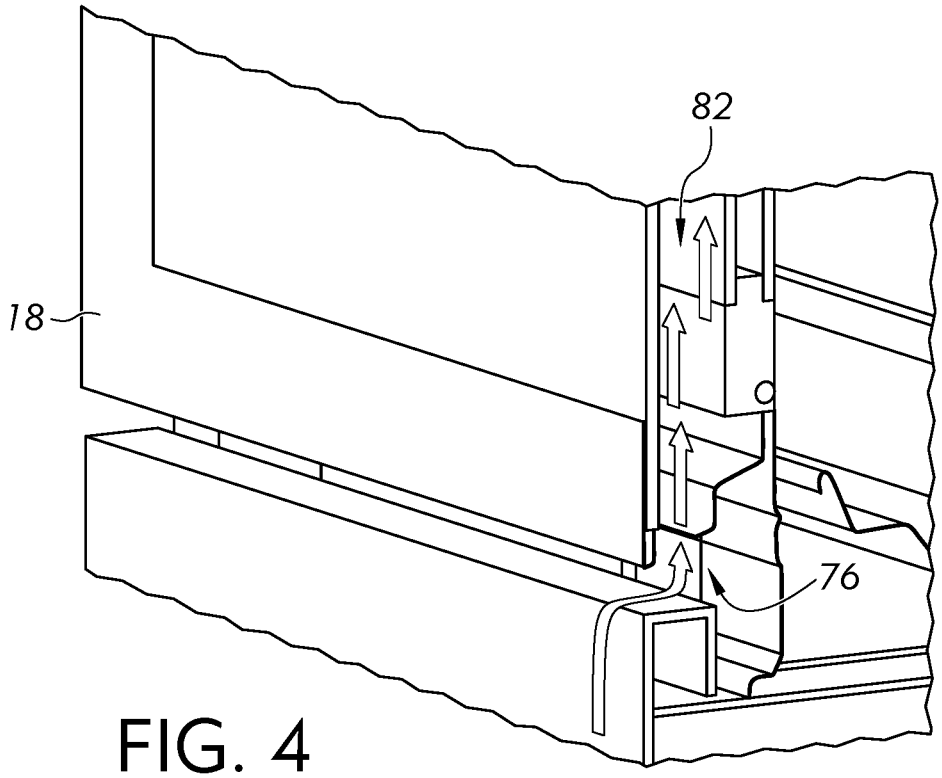
FIG. 4 is enlarged cross-section view showing a lower portion of the door.
Figure 5:
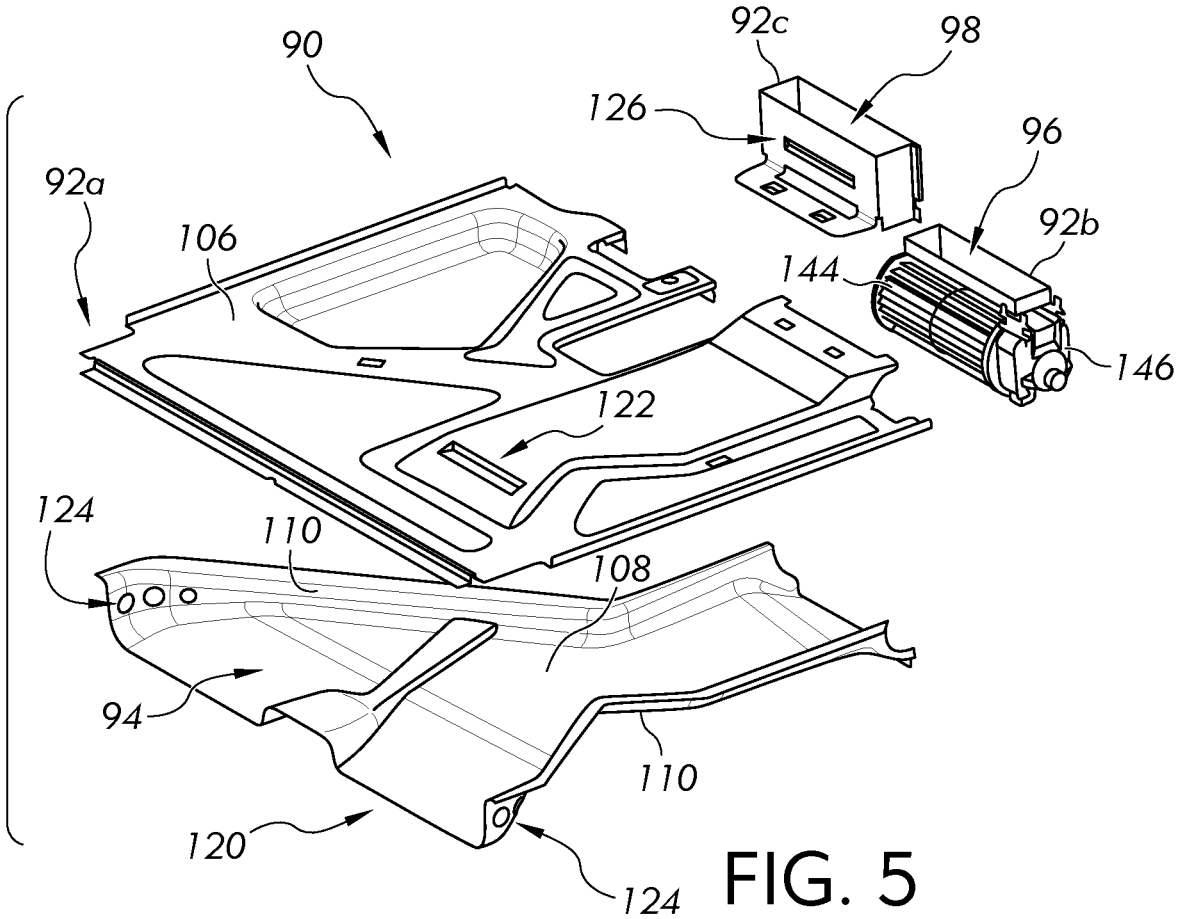
FIG. 5 is an exploded view of a cooling duct for the cooking appliance.
Figure 6:
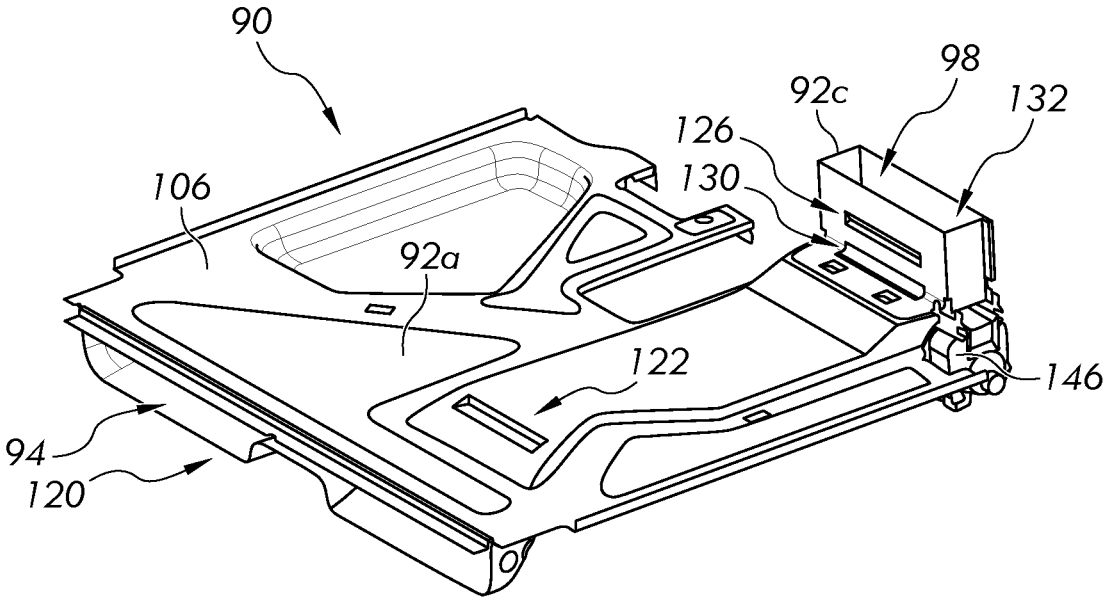
FIG. 6 is a perspective view of the cooling duct when assembled.
Figure 7:
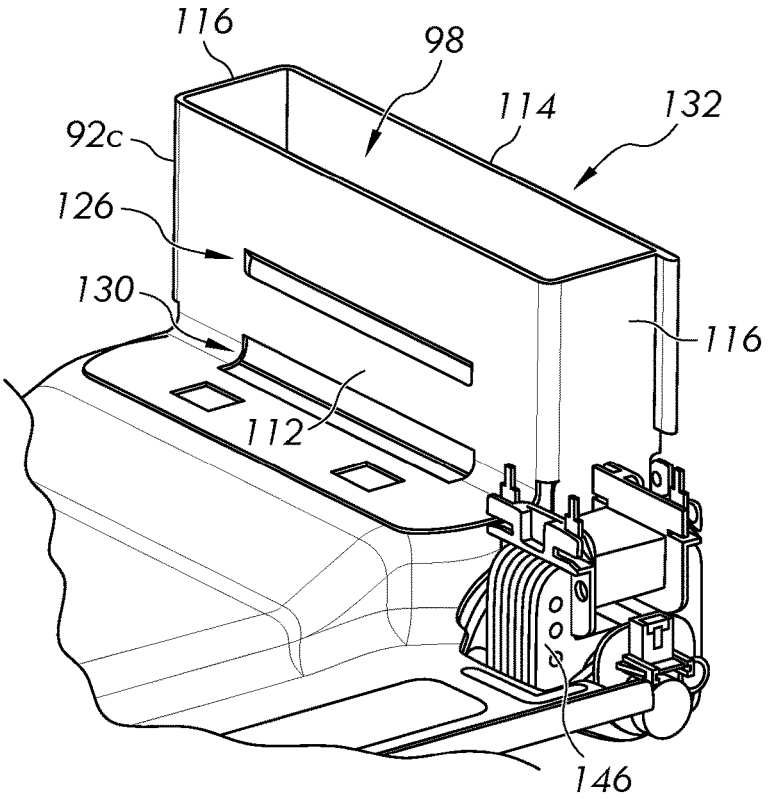
FIG. 7 is an enlarged front-perspective view of the cooling duct focusing on a rear portion thereof.
Figure 8:
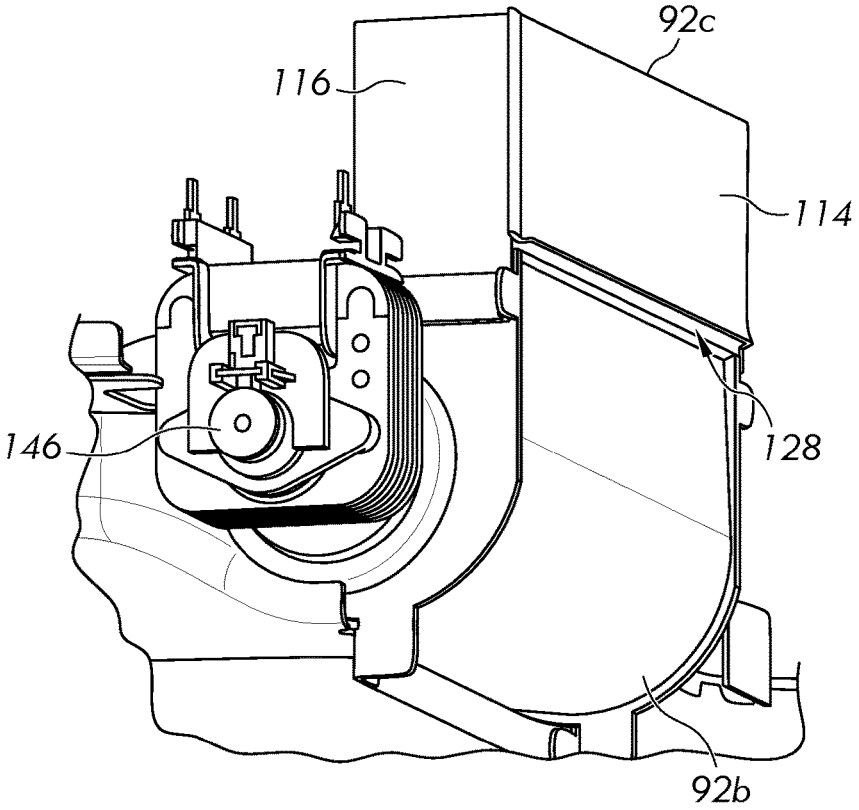
FIG. 8 is an enlarged rear-perspective view of the cooling duct focusing on its rear portion.

The ventilation system is further configured to establish airflow through the door 18. As shown in FIGS. 3 and 4, the door 18 includes a plurality of air inlets 76 at its lower end, a plurality of air outlets 78 at its upper end, and a door channel 82 that extends through the door and fluidly connects the inlets 76 and the outlets 78. Notably, the air outlets 78 are located on a rear side of the door 18 such that air exiting the outlets 78 will flow into the front inlets 72 of the cabinet 12 when the door 18 is in its closed position. However, the number and location of inlets 76 and outlets 78 for the door 18 can also vary in different embodiments. Moreover, the door 18 in some examples can include a plurality of air channels 82 that separately provide communication between the inlets 76 and outlets 78 of the door 18.

As shown in FIGS. 1 and 5-8, the ventilation system further includes a cooling duct 90 arranged within the upper plenum 64*d* above the cooking chamber 14, which extends from the front-panel inlets 72 of the cabinet 12 to the rear outlets 74. The cooling duct 90 includes a horizontal portion 92*a* defining an intake channel 94, a fan-compartment portion 92*b* defining a fan compartment 96, and a vertical portion 92*c* defining an exhaust channel 98. The portions 92*a-c* of the cooling duct 90 can be separate bodies that are connected together such that the fan compartment 96 is downstream from the intake channel 94 and upstream from the exhaust channel 98. However, two or more of the portions 92*a-c* can be integral with each other in some examples. Moreover, the cooling duct 90 may comprise fewer, additional, and/or alternative portions in other embodiments. For instance, the cooling duct 90 in some examples may simply comprise the horizontal portion 92*a*.

The horizontal portion 92*a* of the cooling duct 90 extends substantially horizontally along a front-to-rear direction of the cabinet 12 and comprises an upper wall 106, a lower wall 108, and side walls 110 that collectively define the intake channel 94. Meanwhile, the vertical portion 92*c* of the cooling duct 90 extends substantially vertically and comprises a front wall 112, a rear wall 114, and side walls 116 that collectively define the exhaust channel 98. These portions 92*a*, 92*c* preferably are arranged within the cabinet 12 such that air will be directed horizontally through the intake channel 94 and vertically through the exhaust channel 98. Moreover, the horizontal portion 92 is configured such that the intake channel 94 extends along a substantial depth of the cabinet 12 in the front-to-rear direction, for example to or beyond the rear wall 30*a* of the cooking chamber 14.

The horizontal portion 92*a* of the cooling duct 90 is tapered such that a cross-sectional area of the intake channel 94 (taken normal to the direction of airflow through the intake channel 94) decreases as it proceeds in the downstream direction, toward the rear of the appliance 10. This tapering is desirable because the fan compartment 96 has a narrow width compared to the appliance 10 and is disposed near a side of the appliance 10. However, the cooling duct 90 can have other tapered or non-tapered geometries in other examples.

The cooling duct 90 defines a plurality of air inlets for drawing air into the cooling duct 90 at various locations. For example, the horizontal portion 92*a* of the cooling duct 90 defines a main inlet 120, an upper inlet 122, and a plurality of side inlets 124 that feed air directly into the intake channel 94. The main inlet 120 is disposed at an upstream end of the intake channel 94 adjacent to the front-panel inlets 72 of the cabinet 12, while the upper and side inlets 122, 124 are disposed along a midstream portion of the intake channel 94. Additionally, the vertical portion 92*c* of the cooling duct 90 defines a front inlet 126 and a rear inlet 128 that are disposed along a midstream portion of the exhaust channel 98 and feed air directly into the exhaust channel 98. Furthermore, the horizontal, fan-compartment, and vertical portions 92*a*, 92*b*, 92*c* collectively define a fan-compartment inlet 130 that feeds air directly into the fan compartment 96. The cooling duct 90 also defines a rear outlet 132 disposed at a downstream end of the exhaust channel 98 adjacent to the rear outlets 74 of the cabinet 12.

As discussed further below, the cooling duct 90 is configured to accommodate a main cooling airflow therethrough from its main inlet 120 to the rear outlet 132. Moreover, the upper inlet 122, side inlets 124, front inlet 126, rear inlet 128, and fan-compartment inlet 130 of the cooling duct 90 are auxiliary inlets that accommodate induced auxiliary airflows entering the cooling duct 90 from various areas within the appliance 10. However, it is to be appreciated that the cooling duct 90 can comprise other configurations of one or more auxiliary inlets along its length.

One or more inlets of the cooling duct 90 can be sloped to help facilitate the flow of air through the inlet(s) into the cooling duct 90. For instance, as shown in FIG. 1, the upper inlet 122, front inlet 126, and rear inlet 128 in the present embodiment are each formed by punching or bending portions of the cooling duct 90 to create sloped surfaces that define the inlet such that the airflow through the respective inlet gradually converges with the airflow through the cooling duct 90 at the inlet at a sloped angle that is non-perpendicular to the airflow through the cooling duct 90 (e.g., within 75° or less of tangent, preferably within 60° or less of tangent, and more preferably within 45° or less of tangent to the airflow through the cooling duct 90 at the point where airflow through the respective inlet converges therewith). This sloping of the respective inlets facilitates drawing air therethrough via a Venturi effect; i.e. air flow through the inlets induced by the main cooling airflow through the cooling duct 90. The other inlets 120, 124, 126, and 130 of the cooling duct 90 can be similarly sloped to yield similarly convergent airflows.

The ventilation system further includes a fan 144 and a motor 146 to selectively drive the fan 144. The fan 144 is a tangential fan and is arranged within the fan compartment 96 of the cooling duct 90 between the intake channel 94 and exhaust channel 98. However, other types of fans (e.g., radial or axial) may be used in other examples. Moreover, the fan 144 may be disposed at other locations within or outside of the cooling duct 90.

When the fan 144 is driven by the motor 146, the fan 144 will draw air from the intake channel 94 of the cooling duct 90, and direct it through the exhaust channel 98 downstream. This movement of air within the cooling duct 90 corresponds to the main cooling airflow and will induce further auxiliary airflows through the plenums 64*a-d* and door channel 82 described above, ultimately into the cooling duct 90 via the inlets 120, 122, 124, 126, 128, and 130 therein, thereby facilitating efficient cooling the door 18 and cabinet 12.

More specifically, the main cooling airflow will enter the air inlets 76 of the door 18 and flow through the door channel 82, thereby cooling the door 18. This air will then exit the door's air outlets 78 and be drawn into the main inlet 120 of the cooling duct 90 (via the front-panel inlets 72 of the cabinet 12). This is the 'main' cooling airflow because it follows the principal cooling circuit through the appliance (defined between the door channel 82 and the cooling duct 90), and is the one into which all auxiliary airflows are drawn via induction through inlets positioned strategically along the length of the cooling duct 90.

One auxiliary airflow will enter the holes 46 in the control panel 24*f* (and/or other air inlets of the control panel 240 and flow through the upper plenum 64*d* toward the cooling duct 90. This auxiliary airflow can be split into three sub-auxiliary airflows that are drawn into the cooling duct 90 via the upper inlet 122, the fan-compartment inlet 130, and the front inlet 126. This airflow will serve to cool the upper panel 24*d* of the portion of the cabinet 12 located above the cooking chamber 14, the control panel 44, and control elements disposed at the control panel 44.

A further auxiliary airflow will enter the rear-panel inlets 70 and into the rear plenum 64*a*. Portions of this airflow can follow a path into and upward through the left and right plenums 64*b*, 64*c* of the appliance 10 before being drawn into the cooling duct 90 via the inlets 124 thereof, thereby cooling the left and right panels 24*b*, 24*c* of the cabinet 12. Other portions will flow upward through the rear plenum 64*a* and enter the cooling duct 90 via rear inlet 128, thereby cooling the rear panel 24*a* of the cabinet 12.

The combined airflows (i.e. the main airflow drawn via the door and the auxiliary airflows drawn from the plenums 64*a-d* of the cabinet 12) are driven by the fan 144 through the rear outlet 132 toward the cabinet's rear outlets 74. The combined airflow will then flow through the rear outlets 74 into the atmosphere above the cabinet 12.

The appliance 10 as described above provides a single-duct ventilation system, whose primary cooling circuit travels from the door 18 through the cooling duct 90 and then out the rear outlets 74, thereby drawing auxiliary cooling air streams throughout the appliance 10 to effectively cool electronics and provide a continuously flowing air curtain over all walls 30 of the cooking chamber 14. In this manner substantially the entire appliance (above the cooking chamber 14 and in the rest of the space between that chamber and the cabinet 12) is cooled utilizing a single main cooling duct 90, with strategically positioned auxiliary inlets that induce flows between the cabinet 12 and the cooking chamber 14. This single-duct system is simpler than and avoids a multi-duct system wherein multiple ducts all converge and are drawn by a common fan, yet it effectively circulates air to cool and vent numerous different subsystems.

Figure 9:
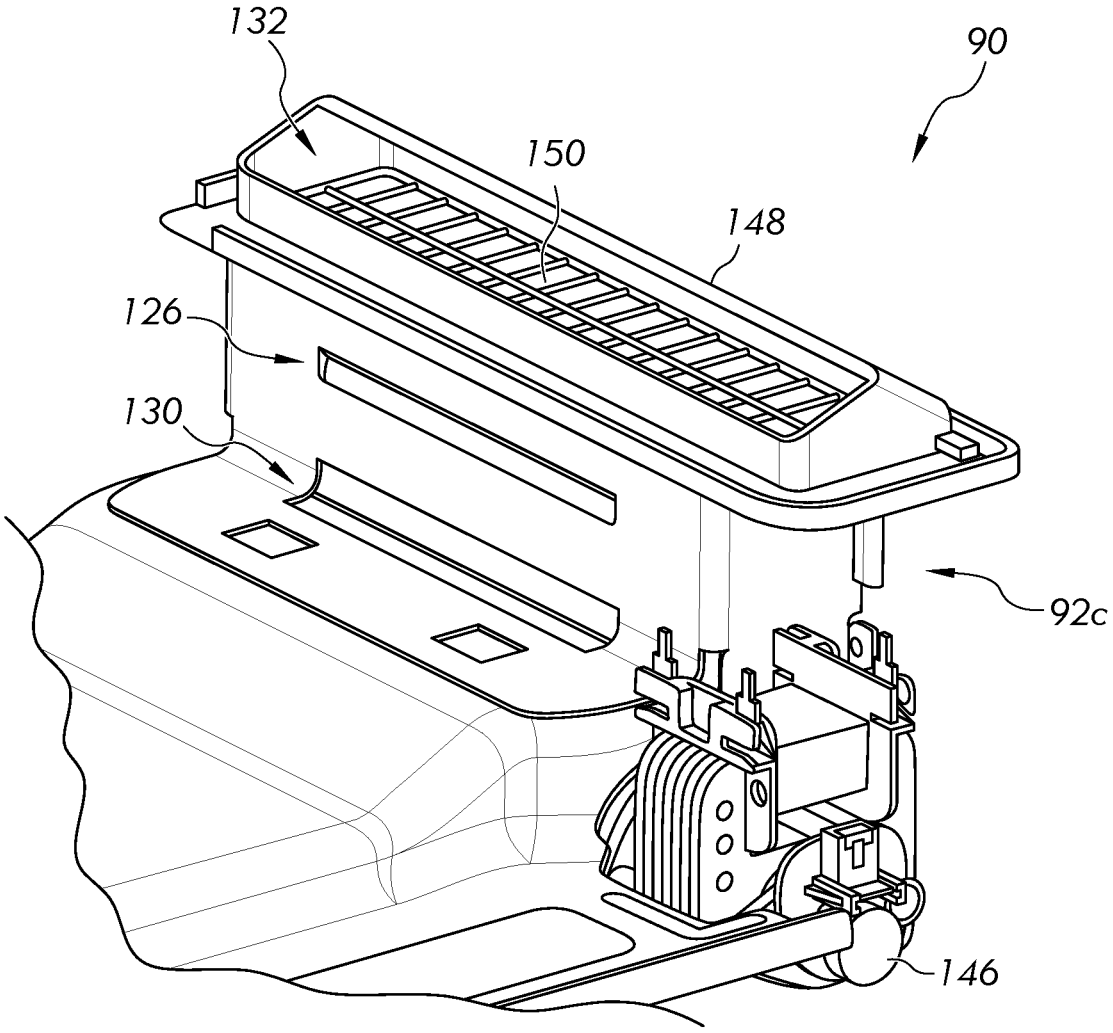
FIG. 9 is an enlarged front-perspective view of an example diverter member for the cooling.

It is to be appreciated that the appliance 10 may be modified in other embodiments. For instance, FIG. 9 shows an example wherein the vertical portion 92*c* of the cooling duct 90 includes a diverter member 148 with a mesh insert 150. This diverter member 148 guides air through the mesh insert 150 and diverts it slightly forward toward the rear outlets 74 of the appliance 10.

Figure 10:
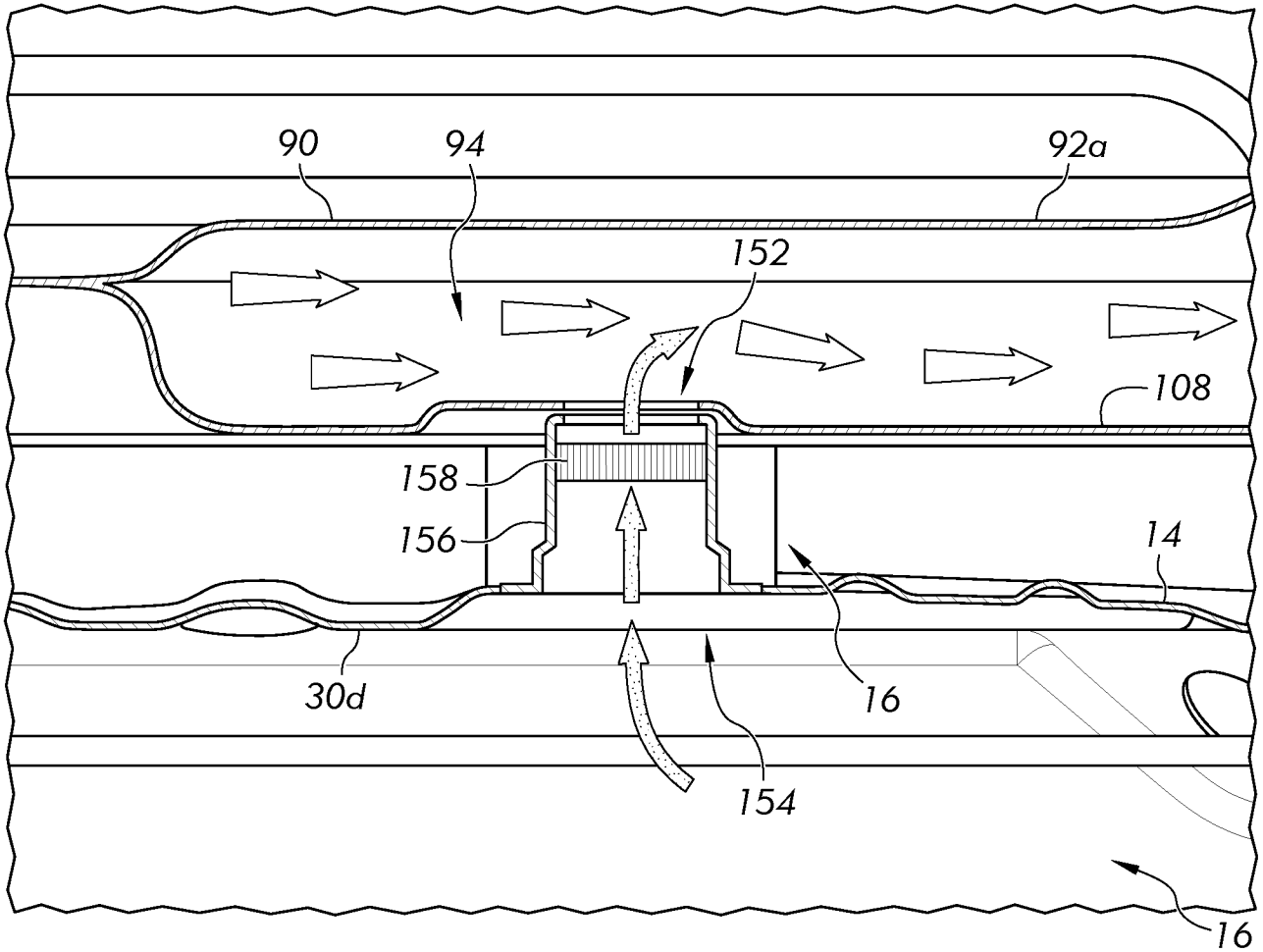
FIG. 10 is an enlarged cross-section view showing an example fume pipe for the cooking appliance.
Figure 11:
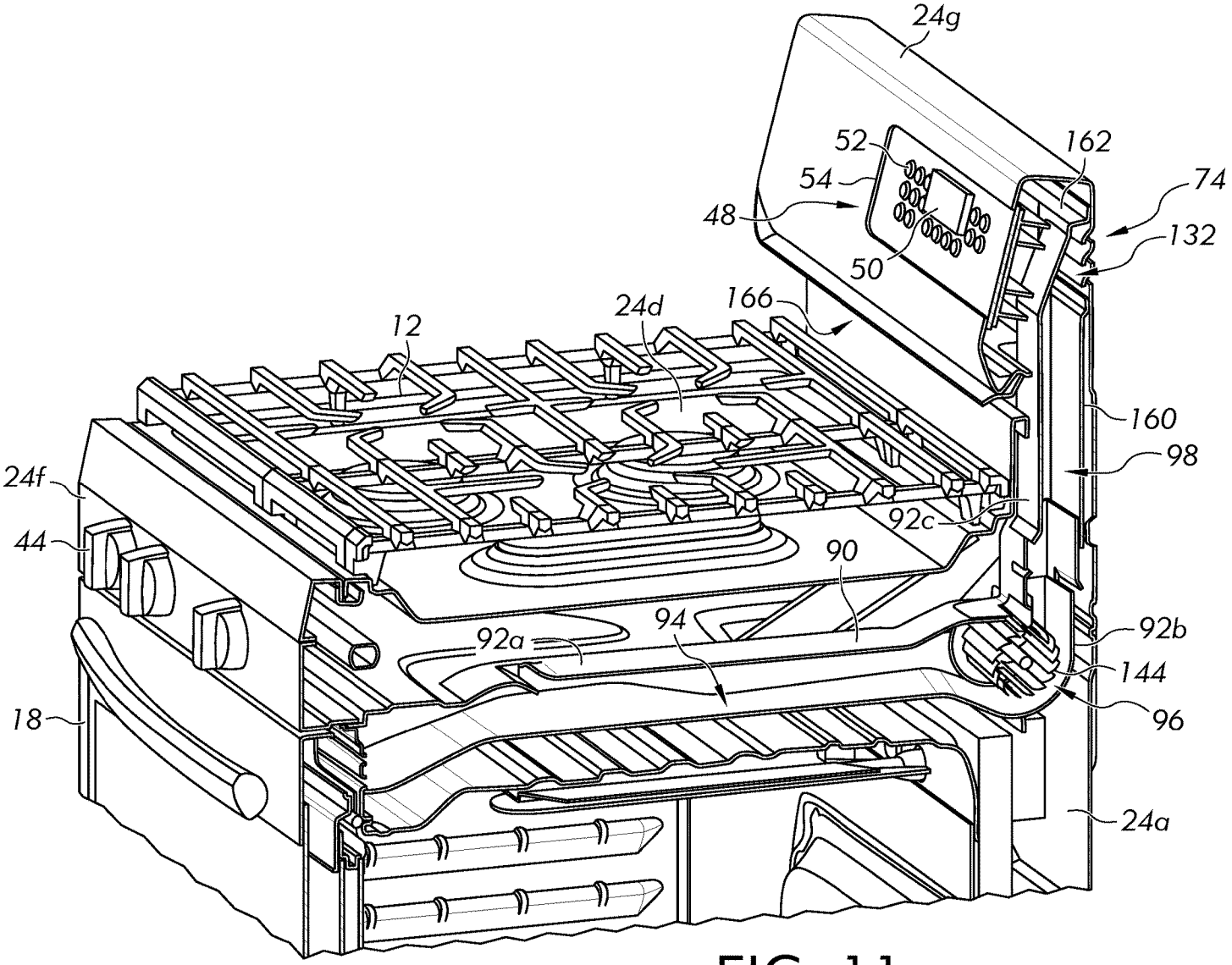
FIG. 11 is a cross-section view of the cooking appliance according to an alternative embodiment.
Figure 13:
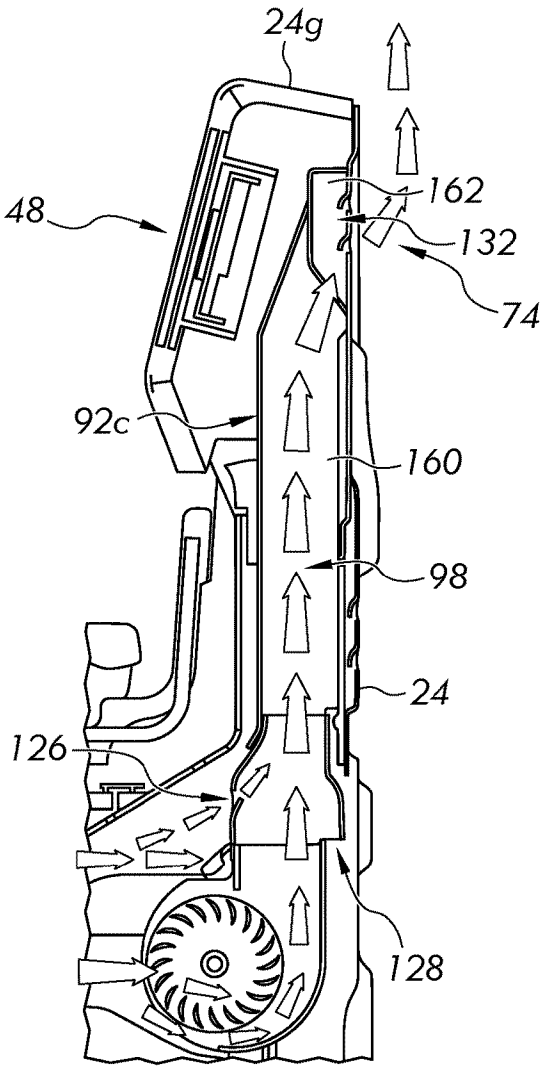
FIG. 13 is an enlarged cross-section view showing a rear control panel of the alternative embodiment.
Figure 12:
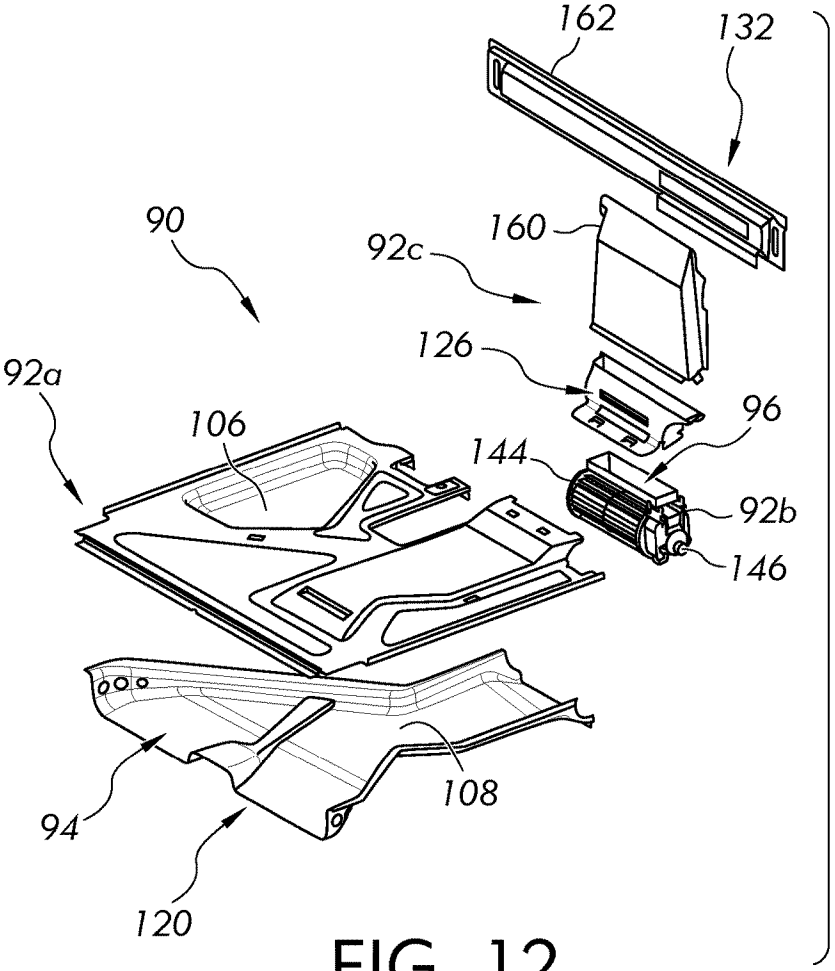
FIG. 12 is an exploded view of the cooling duct for the alternative embodiment.
Figure 14:
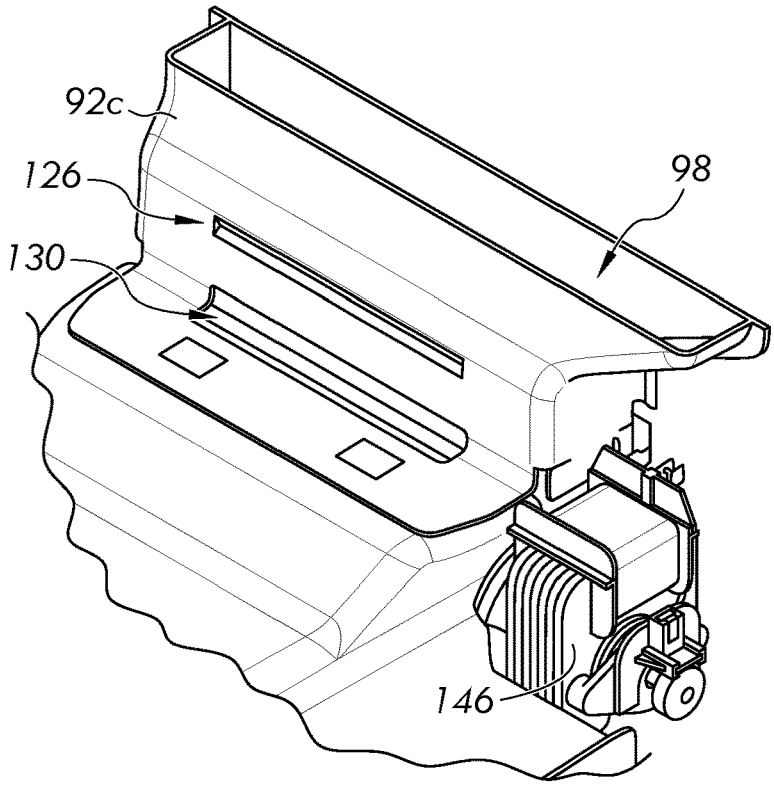
FIG. 14 is an enlarged front-perspective view of the cooling duct focusing on a rear portion thereof for the alternative embodiment.
Figure 15:
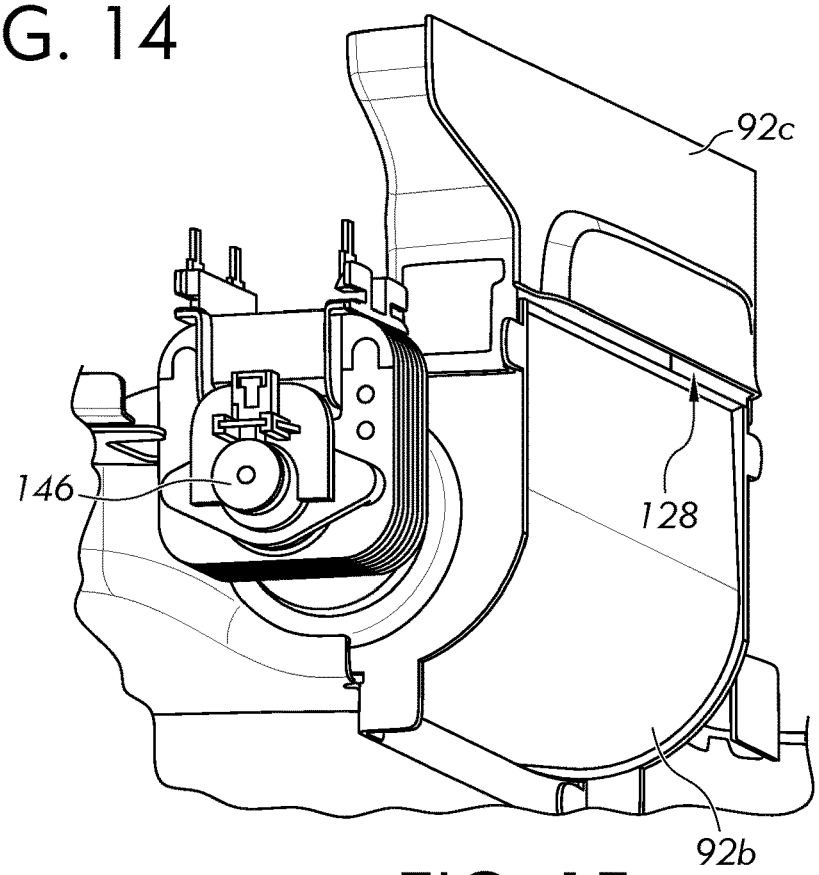
FIG. 15 is an enlarged rear-perspective view of the cooling duct for the alternative embodiment focusing on its rear portion.

FIG. 10 shows an example wherein the cooling duct 90 includes a fume inlet 152 that is defined by its lower wall 108 and located above a fume outlet 154 of the cooking chamber 14. A flue pipe 156 is arranged between the fume inlet 152 and fume outlet 154 to provide fluid communication therebetween, and a vent catalyst 158 can be provided within the flue pipe 156. Operation of the fan 144 will draw fumes within the cooking chamber 14 through its fume outlet 154 into the flue pipe 156. These fumes will pass through the vent catalyst 158 and then flow into the intake channel 94 of the cooling duct 90 via the fume inlet 152, to join the other airflows already therein as part of the combined airflow that will exit via port 132. The mesh insert 150 of the diverter member 148 in FIG. 9 is particularly useful for catching fats, oils, odor particles, and/or hydrocarbons that may be present in the exhaust fumes, particularly exhaust fumes generated by gas heating elements in the cooking chamber 14.

FIGS. 11-17 show an alternative embodiment of the appliance 10 in which the appliance 10 has a rear-control panel 24*g* located at a rear of the appliance 10 that extends upward from its upper panel 24*d*. The rear panel 24*a* of the cabinet 12 extends up to a top of the control panel 24*g* and now defines the cabinet's rear outlets 74. Moreover, the user interface 48 is mounted to a rear side of the control panel 24*g*, and a cutout 158 is provided in the control panel 24*g* to view and interact with the user interface 48.

The cooling duct 90 in this alternative embodiment includes extension pieces 160, 162 that lengthen the vertical portion 92*c* and exhaust channel 98 of the cooling duct 90 so that they reach the elevated rear outlets 74. Moreover, a cross-sectional area of the exhaust channel 98 (taken normal to the direction of airflow through the channel 98) is greater at its downstream end than at its upstream end. This is desirable to diffuse the hot air exiting the rear outlets 74 since it will be directed toward the rear and could impact a wall behind the appliance 10.

Figure 17:
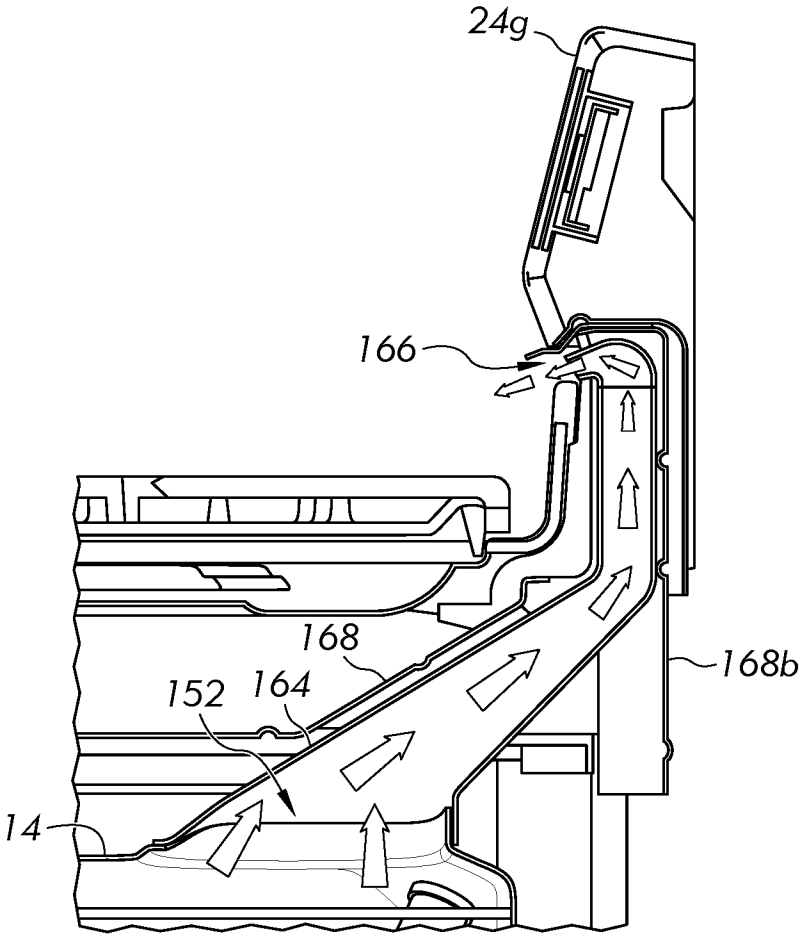
FIG. 17 is an enlarged cross-section view showing the vent tube of the alternative embodiment.
Figure 16:
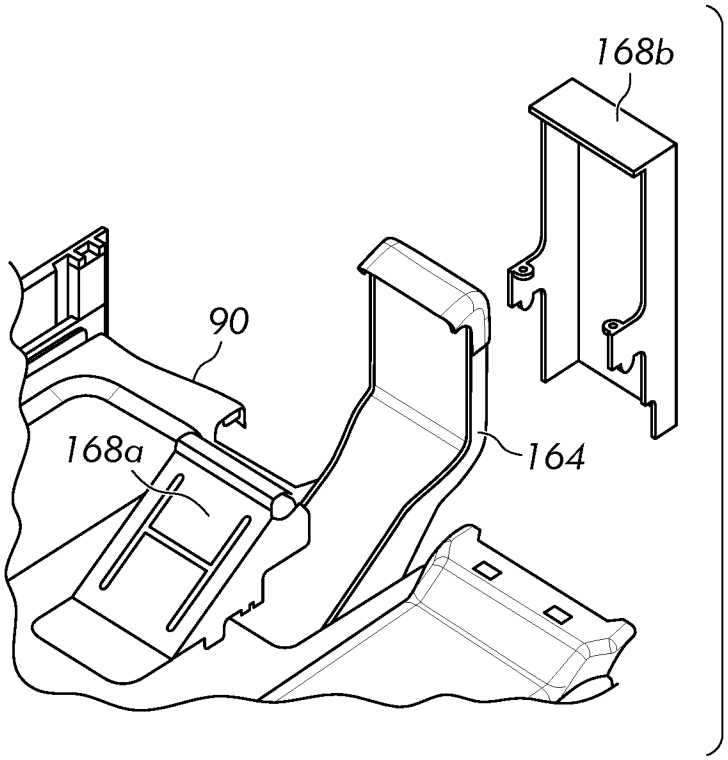
FIG. 16 is an exploded view showing a vent tube and thermal shields for the alternative embodiment.

As shown in FIGS. 16 and 17, exhaust fumes from the cooking chamber 14 of the alternative embodiment can be directed so as not to pass through the cooling duct 90. Instead, a separate vent tube 164 can be provided that extends from the fume outlet 152 of the cooking chamber 14 to a vent 166 located just below the control panel 24*g*. Thermal shields 168*a*, 168*b* are also provided on front and rear sides of the vent tube 164 to prevent the dissipation of heat from the vent tube 164 to surrounding components.

The invention has been described with reference to example embodiments described above. Modifications and alterations will occur to others upon a reading and understanding of this specification. Example embodiments incorporating one or more aspects described above are intended to include all such modifications and alterations insofar as they come within the scope of the appended claims.

What is claimed is:

1. A cooking appliance comprising:

a cabinet;

a cooking chamber positioned within the cabinet;

a cooling duct positioned within the cabinet above the cooking chamber and configured to accommodate a main cooling airflow therethrough, the cooling duct comprising a horizontal portion having an upper wall, a lower wall underneath the upper wall, and a side wall that connects the upper wall and lower wall; and a fan adapted to motivate said main cooling airflow, wherein the cooling duct defines a main inlet at a front of the appliance, an outlet at a rear of the appliance, and a plurality of auxiliary inlets disposed along a length of the cooling duct, said plurality of auxiliary inlets of the cooling duct including a rear auxiliary inlet disposed adjacent to a rear panel of the cabinet, and a side auxiliary inlet disposed in said side wall, wherein the rear panel includes a rear-panel inlet, and operation of the fan causes a first auxiliary airflow to enter the cabinet through the rear-panel inlet, then to flow along a side wall of the cooking chamber, and then into the cooling duct through the side auxiliary inlet.

2. The cooking appliance according to claim 1, said cooling duct comprising:

an intake channel, said main inlet being defined at an upstream end thereof, a fan compartment downstream of the intake channel, and an exhaust channel downstream of the fan compartment, said outlet being defined at a downstream end of the exhaust channel, said rear auxiliary inlet being disposed along the exhaust channel.

3. The cooking appliance according to claim 1, wherein the cooling duct is configured to direct the main cooling airflow horizontally above the cooking chamber and then vertically adjacent the rear panel of the appliance.

4. The cooking appliance according to claim 1, wherein the cooling duct comprises a vertical portion having a front wall and a rear wall spaced from the front wall, said plurality of auxiliary inlets comprising a front auxiliary inlet that extends through and is defined by the front wall of the vertical portion.

5. The cooking appliance according to claim 4, wherein:

the cabinet comprises a control panel having a control-panel inlet, and operation of the fan causes a second auxiliary airflow to enter the cabinet through the control-panel inlet and then to enter the cooling duct through the front auxiliary inlet.

6. The cooking appliance according to claim 1, wherein the cooling duct comprises a vertical portion having a front wall and a rear wall spaced from the front wall, said rear auxiliary inlet being defined by the rear wall of the vertical portion.

7. The cooking appliance according to claim 6, wherein operation of the fan causes a second auxiliary airflow to enter the cabinet through the rear-panel inlet and then to enter the cooling duct through the rear auxiliary inlet.

8. The cooking appliance according to claim 7, wherein the rear auxiliary inlet is configured such that the second auxiliary airflow through the rear auxiliary inlet enters the cooling duct and gradually converges with the main cooling airflow at a sloped angle relative to the main cooling airflow.

9. The cooking appliance according to claim 1, wherein:

the cooling duct comprises a vertical portion having a front wall and a rear wall spaced from the front wall, said plurality of auxiliary inlets includes a front auxiliary inlet defined by the front wall of the vertical portion, and said rear auxiliary inlet of the plurality of auxiliary inlets is defined by the rear wall of the vertical portion.

10. The cooking appliance according to claim 1, wherein the plurality of auxiliary inlets comprises an upper auxiliary inlet defined by the upper wall of the horizontal portion.

11. The cooking appliance according to claim 10, wherein the cabinet comprises a control panel having a control-panel inlet, and operation of the fan causes a second auxiliary airflow to enter the cabinet through the control-panel inlet and then to enter the cooling duct through the upper auxiliary inlet.

12. The cooking appliance according to claim 1, wherein cooling duct comprises a fan-compartment that at least partially houses the fan, the fan compartment defining a fan-compartment inlet configured to feed a second auxiliary airflow directly into the fan compartment.

13. The cooking appliance according to claim 12, wherein the cabinet comprises a control panel having a control-panel inlet, and operation of the fan causes said second auxiliary airflow to enter the cabinet through control-panel inlet and then to enter the cooling duct through the fan-compartment inlet.

14. The cooking appliance according to claim 1, further comprising a door having a lower inlet, an upper outlet, and a door channel extending from the lower inlet to the upper outlet, wherein:

the cabinet has a front inlet arranged adjacent to the upper outlet of the door and the main inlet of the cooling duct, and operation of the fan causes air to flow through the lower inlet into the door channel, then through the upper outlet, then through the front inlet of the cabinet, and then through main inlet of the cooling duct into the cooling duct.

15. The cooking appliance according to claim 1, wherein the cooling duct defines a fume inlet, the cooking chamber comprises a fume outlet, and a flue pipe provides fluid communication between the fume inlet of the cooling duct and the fume outlet.

16. The cooking appliance according to claim 1, wherein:

the cabinet includes a front-panel inlet, a control-panel inlet, and a rear outlet;

the cooking chamber includes a fume outlet;

the cooling duct comprises:

a vertical portion having a front wall and a rear wall spaced from each other, an upper auxiliary inlet defined by the upper wall of the horizontal portion, a front auxiliary inlet defined by the front wall of the vertical portion, and a fume inlet defined by the lower wall of the horizontal portion; and the main inlet is disposed at an upstream end of the horizontal portion, the rear auxiliary inlet is defined by the rear wall of the vertical portion, and the duct outlet is disposed at a downstream end of the vertical portion.

17. The cooking appliance according to claim 16, wherein operation of the fan causes:

the main cooling airflow to flow through the front-panel inlet into the cabinet and then through the main inlet into the cooling duct, a second auxiliary airflow to flow through the control-panel inlet into the cabinet and then through the upper auxiliary inlet into the cooling duct, a third auxiliary airflow to flow through the control-panel inlet into the cabinet and then through the front auxiliary inlet into the cooling duct, a fourth auxiliary airflow to flow through the rear-panel inlet into the cabinet and then through the rear auxiliary inlet into the cooling duct, and fumes within the cooking chamber to flow through the fume outlet of the cooking chamber and then through the fume inlet into the cooling duct.

18. The cooking appliance according to claim 17, said cooling duct comprising a fan-compartment portion defining a fan compartment that is downstream of the horizontal portion and upstream of the vertical portion, said fan being disposed at least partially within the fan compartment.

19. The cooking appliance according to claim 1, further comprising a vent tube configured to accommodate cooking fumes therethrough, the vent tube extending from a fume outlet of the cooking chamber to a vent of the appliance, wherein the vent tube is separate from the cooling duct such that cooking fumes do not pass through the cooling duct.

20. The cooking appliance according to claim 19, further comprising:

a plurality of cooktop heating elements, and a rear control panel located at the rear of the appliance, wherein the vent is located adjacent to and below the rear control panel such that the vent tube exhausts cooking fumes forward through the vent over the cooktop heating elements.

21. The cooking appliance according to claim 20, wherein the cooling duct proceeds upward behind the rear control panel of the appliance and is configured to exhaust cooling airflow rearward through the outlet disposed on a rear side of the appliance.

22. The cooking appliance according to claim 1, wherein operation of the fan induces:

the main cooling airflow to flow through the main inlet into the cooling duct, through the cooling duct, and then out of the outlet, and a second auxiliary airflow to enter the cooling duct through the rear auxiliary inlet such that the second auxiliary airflow converges with the main cooling airflow in the cooling duct.

* * * * *